US012716148B2

(12) United States Patent
Clauss et al.

(10) Patent No.: US 12,716,148 B2
(45) Date of Patent: Aug. 25, 2026

(54) CONTINUOUS FIBRES BASED ON CELLULOSE AND/OR CELLULOSE DERIVATIVES, METHOD FOR THE PRODUCTION THEREOF AND USE THEREOF

(71) Applicants: TECHNIKUM LAUBHOLZ GMBH, Goppingen (DE); CENTROTHERM INTERNATIONAL AG, Blaubeuren (DE)

(72) Inventors: Manuel Clauss, Ostfildern (DE); Andreas Keller, Öpfingen (DE); Frank Hermanutz, Leonberg (DE); Gunter Fauth, Urbach (DE); Marc Vocht, Stuttgart (DE); Michael Buchmeiser, Remshalden (DE)

(73) Assignees: TECHNIKUM LAUBHOLZ GMBH, Goppingen (DE); CENTROTHERM INTERNATIONAL AG, Blaubeuren (DE)

( * ) Notice: Subject to any disclaimer, the term of this patent is extended or adjusted under 35 U.S.C. 154(b) by 734 days.

(21) Appl. No.: 17/926,691

(22) PCT Filed: May 21, 2021

(86) PCT No.: PCT/EP2021/063669
§ 371 (c)(1),
(2) Date: Nov. 21, 2022

(87) PCT Pub. No.: WO2021/234152
PCT Pub. Date: Nov. 25, 2021

(65) Prior Publication Data

US 2023/0193521 A1 Jun. 22, 2023

(30) Foreign Application Priority Data

May 22, 2020 (DE) ..... 10 2020 113 807.5

(51) Int. Cl.

| | |
|---|---|
| ***D01F 9/16*** | (2006.01) |
| ***D06M 13/256*** | (2006.01) |
| ***D06M 13/46*** | (2006.01) |
| *D06M 101/06* | (2006.01) |

(52) U.S. Cl.
CPC ..... *D01F 9/16* (2013.01); *D06M 13/256* (2013.01); *D06M 13/46* (2013.01); *D06M 2101/06* (2013.01); *D06M 2200/30* (2013.01)

(58) Field of Classification Search
CPC ..... D01F 9/16; D06M 13/256; D06M 13/46; D06M 2101/06; D06M 2200/30
See application file for complete search history.

(56) References Cited

U.S. PATENT DOCUMENTS

| | | | | |
|---|---|---|---|---|
| 3,640,285 | A * | 2/1972 | Briskin | A24B 15/16 131/365 |
| 5,504,196 | A * | 4/1996 | Clarke Garegg | C13B 20/14 536/84 |
| 6,120,841 | A | 9/2000 | Parmentier et al. | |
| 2007/0021300 | A1 | 1/2007 | Farant | |
| 2008/0113175 | A1 * | 5/2008 | Ke | B32B 5/02 428/221 |
| 2010/0285223 | A1 | 11/2010 | Park et al. | |
| 2017/0081787 | A1 | 3/2017 | Son et al. | |
| 2019/0062954 | A1 | 2/2019 | Abels et al. | |

FOREIGN PATENT DOCUMENTS

| | | | |
|---|---|---|---|
| CN | 106192212 | B | 7/2018 |
| CN | 111005219 | A | 4/2020 |
| DE | 69809718 | T2 | 12/2003 |
| JP | S5813722 | A | 1/1983 |
| JP | 2001516404 | A | 9/2001 |
| JP | 200777535 | A | 3/2007 |
| JP | 2012-207331 | A | 10/2012 |
| JP | 2016532016 | A | 10/2016 |
| TW | 200902783 | A | 1/2009 |
| WO | WO-2015173243 | A1 | 11/2015 |
| WO | WO-2017137285 | A1 | 8/2017 |
| WO | WO-2020074623 | A1 | 4/2020 |

OTHER PUBLICATIONS

Japanese Office Action for Patent Application No. 2022-569239, dated Jul. 26, 2024.
Taiwan Search Report for Application No. 110114191 dated Apr. 19, 2024.
International Search Report and Written Opinion of the ISA issued in PCT/EP2021/063669, mailed Aug. 10, 2021; ISA/EP.
Ismail Karacan et al. "Enhancement of oxidative stabilization of viscose rayon fibers impregnated with ammonium sulfate prior to carbonization and activation steps" Journal of Applied Polymer Science, vol. 128, No. 2, Sep. 14, 2012 (Sep. 14, 2012), pp. 1239-1249 DOI: 10.1002/app.38496 ISSN: 0021-8995, XP055051165.
German Office Action regarding Patent Application No. 102020113807.5, dated Mar. 8, 2021 (including English machine translation).

* cited by examiner

*Primary Examiner* — Stuart L Hendrickson
(74) *Attorney, Agent, or Firm* — Lippes Mathias LLP

(57) ABSTRACT

A description is given of continuous fibers based on cellulose and/or cellulose derivatives, more particularly for producing flame-retardant textiles or carbon fibers. The cellulose and/or the cellulose derivatives are in a dehydrated form in the continuous fibers. The oxygen content is 29 to 39 wt %, the limiting oxygen index LOI is 25 to 40 (according to DIN EN ISO 6941; 2004-05) and the density is 1.3 to 1.45 g/cm$^3$ (according to DIN 65569-1; 1992-10). The continuous fibers may be produced advantageously by impregnating the starting fibers with a solution, more particularly an aqueous solution, of a specific salt which under thermal conditions releases a dehydrating acid which brings about the dehydration of cellulose and/or of cellulose derivatives in a subsequent thermal stage. The continuous fibers of the invention can be used in particular to produce advantageous carbon fibers.

17 Claims, No Drawings

CONTINUOUS FIBRES BASED ON CELLULOSE AND/OR CELLULOSE DERIVATIVES, METHOD FOR THE PRODUCTION THEREOF AND USE THEREOF

CROSS-REFERENCE TO RELATED APPLICATION

This application is a 371 U.S. National Phase of International Application No. PCT/EP2021/063669, filed May 21, 2021, which claims priority to German Application No. 102020113807.5, filed May 22, 2020. The entire disclosures of the above applications are incorporated herein by reference.

DESCRIPTION

The invention relates to continuous fibers based on cellulose and/or cellulose derivatives, more particularly for producing flame-retardant textiles or carbon fibers, to methods for producing them, and to advantageous uses thereof.

There are a number of continuous fibers based on polymers which comprise modified polyacrylonitrile in the form for example of acrylonitrile/acrylamidine copolymer and represent precursor fibers for carbon fibers which in certain cases are also utilized for the production of flame-retardant textiles. With the majority of the methods known to date, the extruded precursor fibers of carbon fibers have to be converted into the infusible state. This necessitates the costly and complex operating step of the oxidative heat stabilization. This step is carried out under oxygen or under a protective gas atmosphere; the atmosphere involved may comprise gas mixtures with various oxygen contents. The gas pressure employed in the oxidative heat stabilization is for example 0.5 to 1 bar. The heat stabilization is based on final temperatures of between 180 and 300° C. The final temperature is set by way of a slow increase in the temperature, linearly or in stages.

This is the procedure, in general, for the known precursor fibers described above. Where, however, fibers based on cellulose and/or cellulose derivatives are to be used for producing carbon fibers, there is a key problem to be mulled over: one of the events in a customary oxidative heat stabilization of cellulose materials is the elimination of water, starting at 250° C., which triggers unwanted secondary reactions that diminish the quality and diminish the carbon yield as a result of liquid, carbon-containing pyrolysis products during the carbonization. Remedies employed are particularly slow methods or additional chemical reactions, which render the method uneconomic and environmentally harmful. Moreover, further problems arise in the aforementioned stabilization of cellulose, and also affect cellulose derivatives. These include an excessive tar content on the part of these stabilized fibers. The products in question are competitive only when the thermal stabilization can be optimally managed and industrially implemented. It is known, furthermore, that conventionally stabilized cellulose fibers, in terms of their use as flame-retardant textiles, have too low an LOI (limiting oxygen index) (a parameter which is used to describe the fire behavior and which indicates the minimum oxygen concentration of an oxygen-nitrogen mixture at which combustion continues under the respective test conditions), and inadequate strengths, and so the carbonization yield achieved is deficient. The stabilized cellulose fiber obtained, furthermore, does not have an optimal elemental composition and because of the incipient pyrolysis exhibits defects which make it impossible in particular to produce flame-retardant textiles or carbon fibers having good service properties.

The object addressed by the invention, therefore, was that of proposing continuous fibers based on cellulose and/or cellulose derivatives that can be used in particular for producing advantageous flame-retardant textiles and also carbon fibers of improved quality. The intention here is to optimize the oxygen content, the LOI, and the density. The intention herewith, without a deleterious oxidative heat stabilization, is to develop advantageous carbon fibers which are notable in particular for a favorable density, fiber strength, and elongation at break.

It is also intended that the invention should propose an advantageous method by which the continuous fibers can be produced. The aim herewith is to produce competitive, cellulose-based carbon fibers with a quality not inferior to that of conventional carbon fibers based on oil-based polyacrylonitrile. According to the method of the invention, moreover, the $CO_2$ balance and also the energy costs are to be improved/lowered and the sustainability increased. In the production, furthermore, there are to be no toxic offgases produced, such as hydrocyanic acid and oxides of nitrogen. The intention, moreover, is to achieve improved flame-retardancy properties. Other possible operations which are carried out under air or atmosphere proceed too slowly, require additives and do not achieve the requisite qualities, of the cellulose fibers for example. A particular problem addressed by the invention is that too high an oxygen content in the continuous fibers shows the disadvantage that the continuous fibers as a result of the oxidation become brittle and porous and are consequently unable to be processed via standard processes into—for example—flame-retardant textiles, and nor is it possible for high-quality carbon fibers to be produced from these continuous fibers.

The objects above on which the invention is based are achieved by continuous fibers based on cellulose and/or cellulose derivatives, more particularly for producing flame-retardant textiles or carbon fibers, which are characterized in that the cellulose and/or the cellulose derivatives are present in dehydrated form, the oxygen content is 29 to 39 wt %, the limiting oxygen index LOI is 25 to 40 (according to DIN EN ISO 6941; 2004-05) and the density is 1.3 to 1.45 g/cm$^3$ (according to DIN 65569-1; 1992-10).

The degree of dehydration of the dehydrated cellulose or dehydrated cellulose derivatives that are present in the continuous fibers of the invention evidently plays a preeminent part. In this context is it preferred for the degree of dehydration to be at least 1.0, preferably at least 1.5, and particularly preferably at least 2.0. The continuous fibers of the invention are particularly advantageous when the degree of dehydration is at least 2.5 and more particularly 3.0. The particular advantage associated with the aforesaid degree of dehydration is that a thermal stabilization of the fiber is achieved, with retention of the service properties.

The invention set out above is developed in a particularly advantageous way if the oxygen content is 29 to 32 wt %, the limiting oxygen index LOI is 28 to 37 and/or the density is 1.35 to 1.45.

The following further advantageous properties characterize the invention: a fiber strength of 8 to 30 cN/tex, more particularly of 10 to 16 cN/tex (according to DIN EN ISO 5079; 1996-02), an elongation at break of 12 to 25%, more particularly of 10 to 16% (according to DIN EN ISO 5079; 1996-02), and/or a linear density of 0.5 to 18 dtex, more particularly of 1 to 8 dtex (according to DIN EN ISO 1973; 1995-12).

The starting materials in the realization of the present invention are cellulose and/or cellulose derivatives, which in accordance with the invention are present in dehydrated form in the continuous fibers claimed. Originally non-dehydrated fibers of cellulose, more particularly regenerated cellulose, and/or cellulose derivatives are processed on into the advantageous continuous fibers by the method of the invention described below.

Regarding the cellulose fibers and/or regenerated cellulose fibers employed as starting material, the following should be noted: cellulose fibers comprehend fibers which consist very largely of cellulose, more particularly at 80 wt %, preferably at 90 wt % and more particularly at more than 98 wt %, it being particularly preferred for them to consist entirely of cellulose. The fibers in question may more particularly be fibers produced by modern technologies from cellulosic starting material, which may also be referred to as modified or synthetic cellulose fibers. A notable and possible example are viscose fibers, which are produced by the viscose process. That process employs a spinning solution which comprises NMMO (N-methylmorpholine N-oxide) as solvent. Particularly advantageous cellulose fibers are those whose spinning solutions are obtained using ionic liquids as solvents (in this regard see WO 2007/076979). Particularly advantageous regenerated cellulose fibers are those produced by the air gap spinning process. Particularly useful here are tire cord yarns.

A further particularly advantageous embodiment of the invention is the use of cellulose derivatives for producing the continuous fibers of the invention, which in this case comprise the cellulose derivatives likewise in dehydrated form. Particular candidates here are cellulose acetate, cellulose propionate, cellulose butyrate and also the mixed esters thereof. This means that in each case fibers of cellulose acetate, cellulose propionate, cellulose butyrate and mixed esters thereof can be used in individual fibers, but may also be present in blended form in a yarn. Further advantageous cellulose derivatives may be designated: cellulose formate, cellulose carbamate and/or cellulose allophanate.

The continuous fibers of the invention that are described above may be employed advantageously in the production of flame-retardant textiles. In this context the term "textiles" should be interpreted broadly. Hence it includes woven, knitted and nonwoven fabrics and the like. The particular properties of the continuous fibers of the invention in the form of textiles open up advantageous opportunities for use—for instance, for use in fire-resistant vocational clothing, fire-resistant leisure clothing, as fire-resistant textile material for technical use, more particularly in the automotive sector, and in filtration or in thermal insulation, and also as fire-resistant textile material in the construction sector.

The continuous fibers of the invention may with equal advantage be employed in order to produce carbon fibers by carbonization, optionally with subsequent graphitization. In this context the carbon fibers of the invention, more particularly produced from the continuous fibers of the invention that were described above, are notable for having the following advantageous physical values: a density of 1.55 to 1.75 g/cm$^3$, more particularly 1.6 to 1.7 [g/cm$^3$] (according to DIN 65569-1; 1992-10), a fiber strength of 2.0 to 5 GPa, more particularly 2.5 to 4 (according to DIN EN ISO 5079; 1996-02), and an elongation at break of 2 to 5%, more particularly 2.5 to 3.5% (according to DIN EN ISO 5079; 1996-02).

The continuous fibers of the invention can therefore be carbonized advantageously. This is done preferably by heating the continuous fibers under a protective gas in a temperature range from 600° C. to 2400° C., more particularly 1000° C. to 2400° C., with the range from 1200° C. to 1600° C. being preferred. Heating takes place, especially preferably to not more than 1600° C. The resulting carbon fibers, optionally graphitized, usefully have a carbon content of more than 98 wt %. The optional subsequent graphitization takes place preferably through a thermal treatment of 1700 to 3000° C., more particularly 2000° C. to 2500° C., under a protective gas, more particularly under nitrogen. The graphitized carbon fibers have a higher elasticity modulus than merely conventionally carbonized fibers.

A further subject of the invention is an advantageous method for producing continuous fibers based on cellulose and/or cellulose derivatives, more particularly for use in the production of flame-retardant textiles and carbon fibers, more particularly a method for producing the continuous fibers of the invention, which is characterized in that (1) continuous fibers based on cellulose and/or on cellulose derivatives are contacted with a solution, more particularly an aqueous solution, of a salt which under the subsequent thermal conditions releases a dehydrating acid for the dehydration of cellulose and/or cellulose derivatives, more particularly in the form of the ammonium salt of a sulfonic acid, (2) the continuous fibers thus furnished are heated to a temperature of 160° C. to 300° C., more particularly of 180° C. to 240° C., and this temperature is maintained for a period of at least 5 minutes, more particularly of at least 10 minutes, particularly preferably of at least 20 minutes, wherein, during the respective heating and between the heating steps, the furnished continuous fibers are placed under a reduced pressure of 5 mbar to 500 mbar, more particularly of 50 mbar to 200 mbar, in an inert gas atmosphere, more particularly in a nitrogen atmosphere, thus leading, as a result of the dehydrating acid formed, to the dehydration of the cellulose and/or of the cellulose derivative.

In stage (1) according to the invention the continuous fibers are impregnated, so to speak, with a suitable salt, before, in the course of the subsequent thermal stage (2), the dehydrating acid is formed by elimination of ammonia, and this acid in statu nascendi brings about the cellulose and/or cellulose derivative dehydration which is relevant for the invention.

This method is developed advantageously in stage (2) in that the continuous fibers furnished in stage (1) are heated to a first temperature, more particularly of 180 to 240° C., and this first temperature is maintained for a period of at least 5 minutes, and subsequently the furnished continuous fibers are heated to at least one second temperature, which is higher than the first temperature, more particularly of 240 to 300° C., and the second temperature as well is maintained for a period of at least 5 minutes, wherein the furnished continuous fibers, during the respective heating and between the heating steps, are placed under a reduced pressure of 5 mbar to 500 mbar, more particularly of 50 mbar to 200 mbar, in an inert gas atmosphere, more particularly in a nitrogen atmosphere, thus leading, as a result of the dehydrating acid formed, to a dehydration of the cellulose and/or of the cellulose derivative.

The thermal stage (2) above, as addressed above, may be developed advantageously as follows: it is preferable if the furnished continuous fibers are heated in stage (2) in stages from the first temperature to at least one further temperature and then up to the second temperature, with the temperature difference between the temporally successive heating steps being at least 5° C., more particularly at least 10° C., and with the furnished continuous fibers being held at the at least one temperature for a period of at least 3 minutes. It is useful, moreover, if the second temperature is set in stage (2) to be higher by at least 30° C., more particularly by at least 40° C., than the first temperature. It is also considered advantageous if the furnished continuous fibers in stage (2) are held for at least 10 minutes, more particularly at least 20 minutes, at the first temperature, the second temperature, and at least one optional intermediate temperature.

Between stage (1) and stage (2) of the method regime of the invention, it is useful for there to be an intermediate drying, more particularly by contact heat on heated godets, preferably between 60° C. and 140° C., more particularly between 80° C. and 139° C., or in a hot air tunnel, preferably between 60° C. and 140° C., particularly preferably between 80° C. and 120° C. This intermediate drying is preferably performed continuously. The continuous fiber yarn here is wound up after stage (2). The resulting spools are storable and transportable and at a given time are supplied to stage (2), which is preferably carried out continuously.

It is apparent that the method of the invention is preferably a continuous two-stage method which comprises the above-designated stages (1) and (2). In the first stage, a continuous fiber based on cellulose and/or cellulose derivatives is treated with a solution, more particularly with the aqueous solution, of a salt which under the thermal conditions described in the subsequent stage (2) releases a dehydrating acid for the dehydration of cellulose and/or cellulose derivatives under the thermal conditions designated. The agent in question is more particularly an ammonium salt of a sulfonic acid. It is possible in principle here to employ other salts which under the conditions of the invention release a dehydrating acid. Particular possibilities here include the following: ammonium dihydrogen phosphate, diammonium hydrogen phosphate, ammonium phosphonates, ammonium chloride, ammonium hydrogen sulfate and/or ammonium hydrogen carbonate.

The relevant salt which under the thermal conditions designated below releases the dehydrating acid for dehydrating cellulose and/or cellulose derivatives preferably takes the form of an ammonium salt of a sulfonic acid.

Hence it is preferred for the sulfonium salt used in accordance with the invention to have the formula (I)

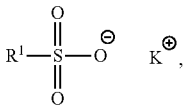

in which: $R^1$ is a hydrocarbon group and $K^+$ is a cation of the formula (II)

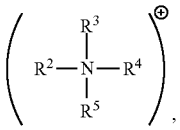

in which $R^2$ to $R^5$ independently of one another are an H atom or an organic group having 1 to 20 C atoms and accordingly the cation is an unsubstituted ammonium ion $(NH^4)^+$ or a substituted ammonium ion.

As shown, it is preferred if $R^1$ is a hydrocarbon group having 1 to 20 carbon atoms, wherein it is particularly preferred if the hydrocarbon group contains 2 to 15 carbon atoms, more particularly 2 to 10 and very preferably from 2 to 5 carbon atoms. In another preferred embodiment $R^1$ is an aromatic group or contains such a group. Hence $R^1$ may optionally be a substituted aryl group, more particularly an optionally substituted phenyl, biphenyl or naphthyl group, or an alkaryl group, more particularly an optionally substituted phenyl, biphenyl or naphthyl group which is bonded to the sulfur atom via an alkylene group.

The cation of the formula (I) is not an arbitrary organic or inorganic cation. Instead it is preferred for it to have the advantageous structure designated above. In this structure, as already observed, $R^2$ to $R^5$, independently of one another, are an H atom and/or an organic group having 1 to 20 C atoms, preferably 2 to 15 C atoms and very preferably 5 to 10 carbon atoms. It may in particular also be an alkyl group having 1 to 4 C atoms. Advantageous substituents covered by these preferred details are: methyl and ethyl substituents.

The quantification of the sulfonium salt originally present in the continuous fibers may advantageously be specified in that the furnished continuous fibers contain 0.1 to 5 wt %, more particularly 0.3 to 2 wt %, of sulfur, based on their dry weight, if they are supplied to the thermal treatment stage (2) outlined below. The designated sulfonium salt of the formula (I) is particularly advantageous when it has a solubility in water of at least 10 parts by weight to 100 parts by weight of water (under standard conditions of 20° C. and 1 bar). With particular advantage, the sulfonium salt is ammonium tosylate.

When sulfonic acid salts are being used, preference is given to a solution in a hydrophilic solvent, more particularly in water or in a hydrophilic organic solvent, alcohol for example. Hydrophilic solvents are more preferably water or mixtures of water with other hydrophilic organic solvents of unlimited miscibility in water; in the case of water in the solvent mixture, this mixture contains preferably at least 50 wt %. Particularly preferred is a solution based entirely on water and containing the sulfonic acid salt of the formula (I) in dissolved form.

The concentration of the sulfonic acid salts in the solution, more particularly the aqueous solution, and the contact times of the continuous fibers with the solution are usefully selected in such a way that the dried continuous fiber contains the advantageous sulfonic acid salt content designated above. For this purpose, the continuous fiber may be passed through the solution for a sufficient time and/or, in continuous operation, may be passed through a sufficiently long solution bath.

In one preferred embodiment the continuous fibers are passed continuously through the solution of the sulfonic acid salt. The sulfonic acid salt content of the solution is preferably 0.05 to 5 mol/l of solution, more particularly 0.1 mol to 2 mol/l of solution. The contact time of the continuous fibers with the solution of the sulfonic acid salts is preferably at least 0.5 second, more particularly at least 2 and very preferably at least 10 seconds. It is generally not longer than 100 seconds, preferably not longer than 30 seconds.

The continuous fibers of the invention, based on cellulose and/or cellulose derivatives, may be furnished additionally with further adjuvants. For this purpose, in particular, the solution of the designated sulfonic acid salt may comprise such further additives. These may be, in particular, auxiliaries for stabilizing thread transport, preferably fatty acids, such as long-chain aliphatic monocarboxylic acids. Saturated fatty acids are particularly suitable, such as palmitic acid or oleic acid, for example.

These additional additives ought preferably to have a solubility in water of at least 10 parts by weight, preferably of at least 20 parts by weight, more particularly of at least 30 parts by weight to 100 parts by weight of water under standard conditions (20° C., 1 bar). The additives are preferably compounds of low molecular weight, having a molar weight of not more than 1000 g/mol, more particularly of not more than 300 g/mol. Particular additives contemplated are soaps or acids, examples being inorganic salts, inorganic acids, organic salts or organic acids, such as carboxylic acids or phosphonic acids. In the case of salts, the cations may be for example metal cations, preferably alkali metal cations, such as $NH^+$ and $K^+$, or more particularly, ammonia $(NH^4)^+$. Moreover, in a preferred embodiment, the continuous fibers in accordance with the invention contain no further additives in relevant amounts apart from the sulfonic acid salt of the formula (I) that has been extensively elucidated above.

Regarding the method of the invention, the following general statements may be made for further elucidation: the advantageous properties addressed in connection with the continuous fibers of the invention are achieved in a targeted and reliable way by the evolution, within the thermal stage (2) addressed, of a dehydrating acid, which in the carbon fiber production context may also be referred to as a "carbonizing aid". A low-pressure stabilization oven which can be used has recently become known. It is particularly significant to the realization of the invention. The values specified in the context of the thermal stage (2) are preferred. Here, first of all, a multiplicity of continuous fibers of the invention, extending in parallel with one another and based on cellulose and/or on cellulose derivatives, are passed from the feed unit via an airlock unit into the operating unit. From the operating unit, the continuous fibers are passed via an airlock unit and then to a take-up unit, where they are taken up again. The operating unit is placed under a reduced pressure of 5 mbar to 500 mbar, more particularly of 50 mbar to 300 mbar. A pressure range from 50 to 200 mbar has proven particularly advantageous here. Via the gas supply, the operating unit is subjected to process gas, preferably to an inert gas, preferably to nitrogen, which is drawn off again via a vacuum pump. The gas that is drawn off contains not only ammonia but also the water eliminated as a result of the dehydration of cellulose and/or the cellulose derivatives. The gas drawn off is purified via a corresponding aftertreatment step.

Furthermore, the heating elements are targeted at the operating unit, and so in its respective zone they generate the desirable, more particularly constant, temperature. In the first zone, for example, in the case of the multistage embodiment, a temperature of 180° C. to 240° C. is established. In the following zones, for example, temperatures of 200° C., 220° C., 240° C. and 250° C. are established. The continuous fibers are then passed through the operating unit at a predetermined speed, the speed usefully being established such that the continuous fibers take about 20 to 40 minutes to be passed through the entire heated operating unit.

It has been able to be determined that in the controlled reduced-pressure atmosphere, it is possible to employ higher temperatures than in the case of atmospheric pressure in air, without the continuous fibers burning and becoming thermally damaged. As a result it is possible reproducibly to produce uniformly stabilized, in the case of carbon fibers, precursor fibers, comprising the cellulose and/or the cellulose derivatives in dehydrated form, with high density.

In summary, the following may be stated with regard to the invention in terms of the advantages associated with it:

The continuous fibers of the invention comprising cellulose and/or cellulose derivatives in dehydrated form exhibit outstanding advantages in connection with the flame-retardancy properties LOI, the strength, the purity, the carbon yield (high carbon yield in carbon fiber production), the density, the elongation, the top properties as precursors for carbon fibers, preferably as advantageous carbon fibers, as a result of a good environmental balance, and with low price, as flame-retardant fibers with advantageous applications. The method of the invention avoids the disadvantageous stage of the oxidative heat stabilization. It employs a low-pressure process and preferably uses an inert gas, more particularly nitrogen. Further features of the method are that it can be performed continuously and scalably, requires a low residence time, employs a temperature in only a low range, enables controlled and early dehydration and also a low level of formation of by-products, does not produce any toxic offgases, and exhibits a very good $CO_2$ balance. Lastly, it allows the advantageous use of cellulose and derivatives and also tire cord.

The intention of the examples below is to provide further elucidation of the invention. They are preceded by the following elucidations:

The limiting oxygen index (LOI) of standard cellulose fibers is 20. The LOI is a parameter which is used for describing the fire behavior. The numerical index indicates the minimum oxygen concentration of an oxygen-nitrogen mixture under which combustion is maintained under the test conditions. The method of the invention produces flame-retarded cellulose fibers with an increased LOI of between 25-40. The flame-retarded cellulose fibers are distinguished by a high density of between 1.3 and 1.45 g/cm$^3$ and additionally by a pore-free structure and a smooth surface. The individual fibers are not stuck to one another, and possess linear densities of between 0.90 and 1.45 dtex. The carbon content of the flame-retarded cellulose fibers is between 55 and 60 wt %, the oxygen content 29 to 39 wt %.

The Cellulose Fibers Used:

The examples used are two types of cellulose fiber. Both are man-made fibers formed from regenerated or coagulated cellulose, respectively. The regenerated cellulose fiber, which is used in automobile tires, is a tire cord fiber. The coagulated cellulose fibers were produced from cellulose dissolved in ionic liquid (1-ethyl-2-methylimidazolium octanoate [EMIM][Oct]). They are referred to below as IL fibers. Both types of fiber are notable for particularly high tensile strengths.

The Carbon Fibers Obtained:

In accordance with the invention, the flame-retarded cellulose fibers may be further processed into carbon fibers (CF). In that case the flame-retardant cellulose fibers are converted by pyrolysis into a CF. The pyrolysis is carried out in general at temperatures of 500 to 1400° C. It can be carried out under protective gas, e.g. nitrogen or helium. The carbon fibers obtained have very good mechanical properties, particularly a good strength and elasticity. The method of the invention enables an increased carbon yield. The carbon yield is 70 to 90%, meaning that the carbon fiber contains between 70 and 90 wt % of the carbon present in the cellulose fiber.

EXAMPLE 1

The production of a flame-retarded cellulose fiber of the invention is described. For furnishing with the additive, a technical regenerated cellulose fiber yarn which is used as tire cord fiber is presented, having a single-filament density of 2.2 dtex and comprising 1000 filaments.

The fiber is furnished and dried in a continuous operation on godets. All of the godets have a speed of 10 m/min. The first godet serves as an unwind unit for the fibers. Prior to being furnished, the fibers are washed by washing with water (95° C.) in washing baths and godets sprayed with water. The fiber is subsequently passed through an aqueous ammonium tosylate solution (ammonium tosylate concentration: 0.35 mol/kg). This is followed by drying on a heated godet (80° C.). The dried fiber is wound up using a tension-controlled winder under an initial tension of 0.3 cN/tex (stage 1).

The regenerated cellulose fiber furnished with the dehydrating additive is subsequently processed further under protective gas (nitrogen) and under reduced pressure (200 mbar). This processing takes place using a low-pressure oven with 24 heating zones. The fibers are unwound over a triple godet and taken into the process tunnel of the oven through three pressure locks. The pressure locks are sealed off from one another by a respective pair of rolls. The pressure in the locks and in the process tunnel is regulated by vacuum pumps and by supply of nitrogen. The furnished cellulose fibers are drawn through the oven at a speed of 0.2 m/min, corresponding to a residence time of 60 min. The temperature is set between 195 and 240° C. The fibers are subsequently removed from the oven again via three pressure locks and are wound up with an initial tension of 4 cN/tex (stage 2).

The residual mass of fiber is 86 wt %, the density of the fibers is 1.42 g/cm$^3$, the strength is 16 cN/tex, the elongation at break is 25%, the LOI is 30.5 and the oxygen content is 30 wt %.

EXAMPLE 2

The fiber is produced as in example 1. The residence time in the low-pressure oven is shortened to 30 min.

The residual mass of fiber is 86 wt %, the density of the fibers is 1.40 g/cm$^3$, the strength is 16 cN/tex, the elongation at break is 21%, the LOI is 29, and the oxygen content is 32 wt %.

EXAMPLE 3

The fiber is produced as in example 1. The residence time in the low-pressure oven is shortened to 15 min.

The residual mass of fiber is 86 wt %, the density of the fibers is 1.39 g/cm$^3$, the strength is 13 cN/tex, the elongation at break is 21%, the LOI is 26, and the oxygen content is 38 wt %.

EXAMPLE 4

The production of carbon fibers from the flame-retarded cellulose fibers of the invention is described. The flame-retarded cellulose fibers are produced, as described in example 1, by means of an additized regenerated cellulose fiber, a so-called tire cord fiber, which is processed using the low-pressure process. The flame-retarded cellulose fibers thus produced are subsequently processed under protective gas in two stages to give carbon fibers. In the first stage the fiber is treated at a maximum temperature of 750° C. Thereafter the fibers are treated further in a second stage at 1400° C.

The carbon yield is 72 wt %, the strength of the carbon fibers is 2.5 GPa, the elasticity modulus is 96 GPa, the elongation at break is 2.5%, and the density is 1.42 g/cm$^3$.

EXAMPLE 5

The production of carbon fibers from the flame-retarded cellulose fibers of the invention is described. The flame-retarded cellulose fibers are produced, as described in example 2, by means of an additized tire cord fiber, which is processed using the low-pressure process. The flame-retarded fibers are subsequently processed under protective gas in two stages, as described in example 4, to give carbon fibers.

The carbon yield is 72 wt %, the strength of the carbon fibers is 23.2 GPa, the elasticity modulus is 110 GPa, the elongation at break is 2.8%, and the density is 1.7 g/cm$^3$.

EXAMPLE 6

The production of carbon fibers from the flame-retarded cellulose fibers of the invention is described. The flame-retarded cellulose fibers are produced, as described in example 3, by means of an additized tire cord fiber, which is processed using the low-pressure process. The flame-retarded fibers are subsequently processed under protective gas in two stages, as described in example 4, to give carbon fibers.

The carbon yield is 82 wt %, the strength of the carbon fibers is 2.6 GPa, the elasticity modulus is 82 GPa, the elongation at break is 2.5%, and the density is 1.68 g/cm$^3$.

EXAMPLE 7

The production of flame-retarded cellulose fibers of the invention is described. The starting material used is regenerated cellulose fibers from an air gap spinning process, spun directly from ethyl-, methyl-imidazolium octanoate (IL fibers), having a single-filament density of 2.2 dtex and comprising 1000 filaments. The flame-retarded cellulose fibers are produced as in example 1 after furnishing with an additive (ammonium tosylate) by the low-pressure process.

The residual mass of fiber is 78 wt %, the density of the fibers is 1.38 to 1.42 g/cm$^3$, the strength is 12 cN/tex, the elongation at break is 13%, and the LOI is 31.

EXAMPLE 8

The production of carbon fibers from the flame-retarded IL fibers of the invention is described. The flame-retarded cellulose fibers are produced as in example 7. The flame-retarded fibers are subsequently processed under protective gas in two stages, as described in example 4, to give carbon fibers.

The carbon yield is 80 wt %, the strength of the carbon fibers is 2.5 GPa, the elasticity modulus is 90 GPa, the elongation at break is 2.5%, and the density is 1.69 g/cm$^3$.

The invention claimed is:

1. Continuous fibers based on cellulose and/or cellulose derivatives characterized in that the cellulose and/or the cellulose derivatives are present in dehydrated form, the oxygen content is 29 to 39 wt %, the limiting oxygen index LOI is 25 to 40 according to DIN EN ISO 6941; 2004-05, and the density is 1.3 to 1.45 g/cm$^3$ according to DIN 65569-1; 1992-10.1 wherein the degree of dehydration of the cellulose and/or of the cellulose derivatives is at least 1.0.

2. The continuous fibers as claimed in claim 1, characterized in that the degree of dehydration of the cellulose and/or of the cellulose derivatives is at least 1.5.

3. The continuous fibers as claimed in claim 1, characterized in that the degree of dehydration is at least 2.5.

4. The continuous fibers as claimed in claim 1, characterized in that the oxygen content is 29 to 32 wt %, the limiting oxygen index LOI is 28 to 37 and/or the density is 1.35 to 1.45.

5. The continuous fibers as claimed in claim 1, characterized in that they have a fiber strength of 5 to 30 cN/tex, an elongation at break of 12 to 25% according to DIN EN ISO 5079; 1996-02, and/or a linear density of 0.5 to 18 dtex according to DIN EN ISO 1973; 1995-12.

6. The continuous fibers as claimed in claim 1, characterized in that the continuous fibers comprising dehydrated cellulose originate from regenerated cellulose fibers and the continuous fibers which comprise dehydrated cellulose derivatives originate from continuous fibers of esters or ethers of cellulose.

7. A method for producing continuous fibers based on cellulose and/or cellulose derivatives as claimed in claim 1, characterized in that (1) continuous fibers based on cellulose and/or on cellulose derivatives are contacted with a solution of a salt which under the subsequent thermal conditions releases a dehydrating acid for the dehydration of cellulose and/or cellulose derivatives in the form of the ammonium salt of a sulfonic acid, (2) the continuous fibers thus furnished are heated to a temperature of 180° C. to 300° C. for a period of at least 5 minutes wherein, during the respective heating and between the heating steps, the furnished continuous fibers are placed under a reduced pressure of 5 mbar to 500 mbar in an inert gas atmosphere, thus leading, as a result of the dehydrating acid formed, to the dehydration of the cellulose and/or of the cellulose derivative.

8. The method for producing continuous fibers based on cellulose and/or cellulose derivatives as claimed in claim 7, characterized in that in stage (2) the continuous fibers furnished in accordance with stage (1) are heated to a first temperature of between 180° C. to 240° C. for a period of at least 5 minutes, and subsequently the furnished continuous fibers are heated to at least one second temperature of between 240° C. to 300° C. for a period of at least 5 minutes, wherein the furnished continuous fibers, during the respective heating and between the heating steps, are placed under a reduced pressure of 5 mbar to 500 mbar in an inert gas atmosphere, thus leading, as a result of the dehydrating acid formed, to a dehydration of the cellulose and/or of the cellulose derivative.

9. The method as claimed in claim 7, characterized in that between stages (1) and (2) a drying is provided at a temperature of 60° C. to 140° C., wherein the moisture content of the continuous fibers supplied to stage (2) is adjusted to about 1 to 4 wt %.

10. The method as claimed in claim 7, characterized in that the sulfonic acid salt has the formula (I)

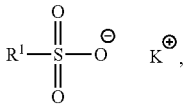

in which R1 is a hydrocarbon group and $K_+$ is a cation of the formula (II)

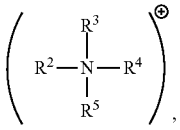

in which R2 to R5 independently of one another are an H atom or an organic group having 1 to 20 C atoms and the cation represents a substituted or unsubstituted ammonium ion.

11. The method as claimed in claim 10, characterized in that the furnished continuous fibers contain 0.1 to 5 wt % of sulfur, based on the dry weight of the furnished continuous fibers.

12. The method as claimed in claim 10, characterized in that the sulfonic acid salt of the formula (I) in water has a solubility of at least 10 parts by weight to 100 parts by weight of water.

13. The method as claimed in claim 7, characterized in that the furnished continuous fibers in stage (2) are heated in stages from the first temperature to at least one further temperature and then up to the second temperature, where the temperature difference between the temporally successive heating steps is at least 5° C., and where the furnished continuous fibers are held at the at least one temperature for a period of at least 3 minutes.

14. The method as claimed in claim 7, characterized in that the second temperature in stage (2) is set to be higher by at least 30° C. than the first temperature.

15. The method as claimed in claim 7, characterized in that the furnished continuous fibers in stage (2) are held for at least 10 minutes at the first temperature, the second temperature, and at least one optional intermediate temperature.

16. An article of clothing comprising clothing comprising the material of claim 1 for producing flame-retardant textiles for use in fire-resistant vocational clothing, fire-resistant leisure clothing, as fire-resistant textile material for technical use, and in filtration or in thermal insulation, and also as fire resistant textile material in the construction sector.

17. A process of making a carbon fiber comprising carbonizing the material of claim 1.

* * * * *